United States Patent [19]

Nagai et al.

[11] 4,384,178

[45] May 17, 1983

[54] DISTRIBUTOR FOR AN INTERNAL COMBUSTION ENGINE CONTAINING AN APPARATUS FOR SUPPRESSING NOISE

[75] Inventors: Masahiko Nagai; Minoru Yano, both of Toyota, Japan

[73] Assignee: Toyota Jidosha Kogyo Kabushiki Kaisha, Toyota, Japan

[21] Appl. No.: 201,442

[22] Filed: Oct. 28, 1980

[30] Foreign Application Priority Data

Jul. 29, 1980 [JP] Japan ..... 55-103053

[51] Int. Cl.[3] ..... H01H 19/00

[52] U.S. Cl. ..... 200/19 R; 123/633; 200/19 DR; 200/19 DC

[58] Field of Search ..... 200/19 R, 19 A, 19 DR, 200/19 DC, 21; 123/633, 146.5 A, 146.5 R

[56] References Cited

U.S. PATENT DOCUMENTS

| | | | |
|---|---|---|---|
| 2,227,972 | 1/1941 | Hood et al. | 200/19A |
| 2,418,504 | 4/1947 | Frei | 200/21 |
| 3,949,721 | 4/1976 | Hori et al. | 200/19 DR X |
| 3,954,094 | 5/1976 | Huebner et al. | 200/19 DR X |
| 4,007,342 | 2/1977 | Makino et al. | 200/19 R |
| 4,039,787 | 8/1977 | Hori et al. | 200/19 R |
| 4,308,436 | 12/1981 | Sone et al. | 200/19 R |

FOREIGN PATENT DOCUMENTS

| | | |
|---|---|---|
| 44-4812012 | 5/1969 | Japan . |
| 48-5215736 | 12/1973 | Japan . |
| 49-5215737 | 4/1974 | Japan . |
| 49-5138853 | 6/1974 | Japan . |

*Primary Examiner*—J. R. Scott

*Attorney, Agent, or Firm*—Parkhurst & Oliff

[57] ABSTRACT

A distributor containing an apparatus for suppressing noise is disclosed. The distributor is comprised of a rotor and a plurality of stationary terminals, wherein a hollow insulating member is introduced into a discharging air gap formed between a discharging electrode of the rotor and each of discharging electrodes of the stationary terminals. Thereby, a spark discharge, occurring between the discharging electrodes of the rotor and each said stationary terminal, is generated via a through hole formed inside the hollow insulating member.

24 Claims, 30 Drawing Figures

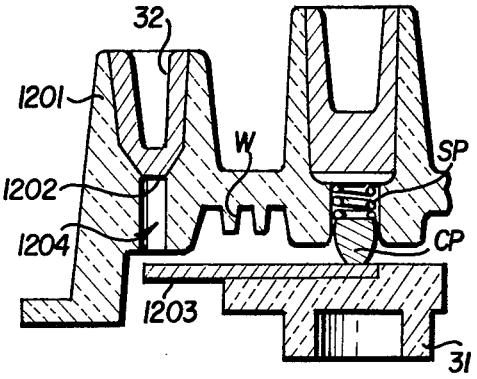
FIG. 12
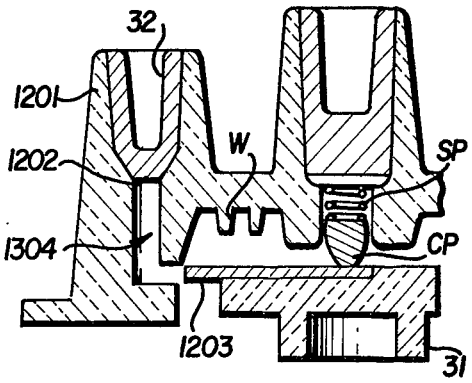
FIG. 13
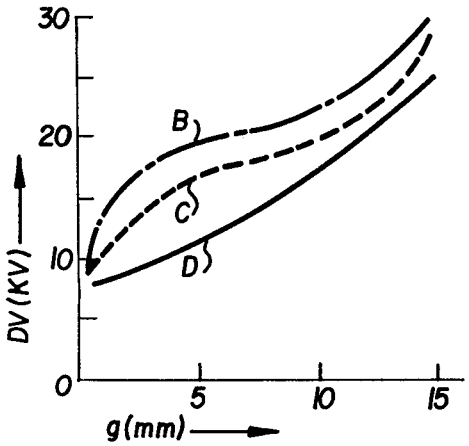
FIG. 14A
FIG. 14B
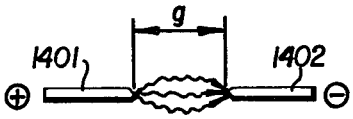
FIG. 14C
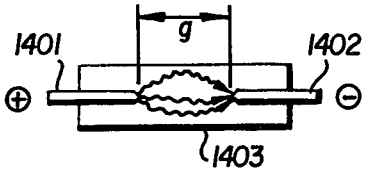
FIG. 14D
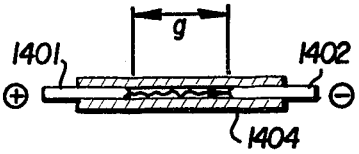

DISTRIBUTOR FOR AN INTERNAL COMBUSTION ENGINE CONTAINING AN APPARATUS FOR SUPPRESSING NOISE

BACKGROUND OF THE INVENTION

1. Field of the Invention

The present invention relates generally to an apparatus for suppressing noise which radiates from the ignition system of an internal combustion engine, and more particularly relates to an apparatus for suppressing noise which generates from the distributor located in the ignition system.

The igniter through which an electric current has to be passed quickly in order to discharge a spark, radiates the noise which accompanies the occurrence of the spark discharge. It is well known that the noise disturbs radio broadcasting service, television broadcasting service and other kinds of radio communication systems and, as a result, the noise deteriorates the signal-to-noise ratio of each of the above-mentioned services and systems. Further, it is very important to know that the noise may also cause operational errors in electronic control circuits, mounted in vehicles, such as E.F.I. (electronic controlled fuel injection system), E.S.C. (electronic controlled skid control system) or E.A.T. (electronic controlled automatic transmission system), and, as a result, traffic safety may be threatened. On the other hand, it has become increasingly important, due to the emphasis on clean exhaust gas for an electric current to be strong and to be intermitted very quickly in order to pass quickly and thereby generate a strong spark discharge. Such a strong spark discharge is accompanied by an extremely loud noise causing the previously mentioned disturbances and operational errors.

2. Description of the Prior Art

For the purpose of suppressing the noise, various kinds of apparatuses or devices have been proposed. Japanese Patent publication No. 48-12012 provides an example of the prior art. In it, the spark gap, between the electrodes of the distributor rotor and the stationary terminal in the distributor is selected to be between 1.524 mm and 6.35 mm, which is wider than the spark gap used in the typical distributor. A second prior art example is Japanese Patent publication No. 51-38853. In it, an electrically high resistive layer is formed on each of the surfaces of the electrodes of the distributor rotor and/or the stationary terminals. A third prior art example is Japanese Patent publication No. 52-15736. In it, an electrically resistive member is inserted in the spark gap formed between the distributor rotor and the stationary terminal, and the spark discharge occurs between the distributor rotor and the stationary terminal, through said electrically resistive member. A fourth prior art example is Japanese Patent publication No. 52-15737. In it, a dielectric member is inserted in the spark gap formed between the distributor rotor and the stationary terminal, and the spark discharge occurs between the distributor rotor and the stationary terminal by way of the surface of said dielectric member.

Thus, a distributor which incorporates either one of the above-mentioned prior art examples can exhibit remarkable suppression of noise when compared to the conventional distributor which contains no apparatus for suppressing the noise.

SUMMARY OF THE INVENTION

It is an object of the present invention to provide an apparatus, for suppressing noise, which is superior to any one of the above-mentioned prior art examples.

DESCRIPTION OF THE DRAWINGS

The present invention will be more apparent from the ensuing description with reference to the accompanying drawings wherein:

FIG. 12 is a partially cross-sectional view of a sixth embodiment;

FIG. 13 is a partially cross-sectional view of a seventh embodiment;

FIG. 14A is a graph depicting resultant data of experiments proving a reduction in the level of the discharge voltage when the hollow insulating member of the present invention is used;

FIGS. 14B, 14C and 14D illustrate layouts of the discharging electrodes used in respective experiments for obtaining characteristics curves Ⓑ, Ⓒ and Ⓓ shown in FIG. 14A;

DESCRIPTION OF THE PREFERRED EMBODIMENTS

Figure 1:
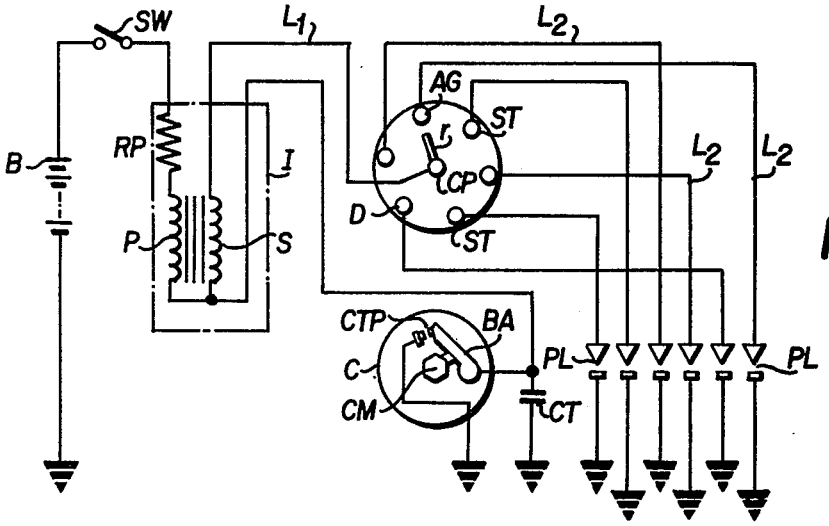
FIG. 1 is a typical conventional wiring circuit diagram of an igniter.

FIG. 1 is a diagram of a typical and conventional wiring circuit for an igniter, the construction of which depends on a so-called battery type ignition system. In FIG. 1, a DC current which is supplied from the positive terminal of a battery B flows through an ignition switch SW, a primary resistor RP of an ignition coil I, a primary winding P thereof and a contact breaker C, to the negative terminal of the battery B. The contact breaker C is comprised of a cam CM which rotates in synchronization with the rotation of the driving shaft (refer to DS to FIG. 2) of the internal combustion engine, a breaker arm BA which is driven by the cam CM and a contact point CTP which acts as a switch turned ON and OFF in cooperation with the breaker arm BA. The symbol CT denotes a capacitor which quenches sparks by absorbing the spark current flowing through the contact point CTP. When the contact point CTP opens quickly, the primary current suddenly stops flowing through the primary winding P. At this moment, a high voltage is electromagnetically induced through a secondary winding S of the ignition coil I. The induced high-voltage surge is transferred through a primary tension cable $L_1$ and applied to the center piece CP located in the center of the distributor D. The center piece CP is electrically connected to the distributor rotor r which rotates within the rotational period synchronized with said driving shaft (refer to DS of FIG. 2). Six stationary terminals ST (assuming that the engine has six cylinders) in the distributor D are arranged with the same pitch along a circular locus. Said circular locus is defined by the rotating electrode of the rotor r, maintaining a discharging air gap AG between the electrode and the circular locus. The induced high-voltage surge is further fed to the stationary terminals ST through said air gap AG every time the electrode of the rotor r comes close to one of the six stationary terminals ST. Then the induced high-voltage leaves one of the terminals ST and further travels through a secondary high tension cable $L_2$ to a corresponding spark plug PL, where spark discharges occur sequentially in the respective spark plugs PL and ignite the fuel air mixture in the respective cylinders.

It is a well-known phenomenon that noise is radiated with the occurrence of a spark discharge. As can be seen in FIG. 1, three kinds of spark discharges occur at three locations in the ignitor. A first spark discharge occurs at the contacts (BA, CTP) of the contact breaker C. A second spark discharge occurs at the air gap AG between the electrode of the rotor r and the electrode of the terminal ST. A third spark discharge occurs at the spark plug PL.

It is a well-known fact that, among the three kinds of spark discharges, the above-mentioned second spark discharge radiates the strongest noise compared with the other spark discharges. That is, the spark discharge which occurs between the electrode of the rotor r and the electrode of the stationary terminal ST, in the distributor D, radiates the strongest noise.

Figure 2:
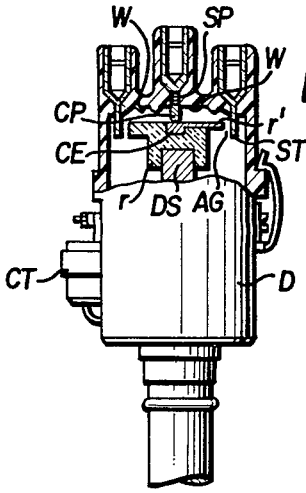
FIG. 2 is a side view, partially cut off, showing a typical conventional distributor "D" shown in FIG. 1.

FIG. 2 is a side view, partially cut off, showing the actual construction of the typical conventional distributor D shown in FIG. 1. In FIG. 2, the members, which are represented by the same reference symbols as those of FIG. 1, are identical to each other. A center electrode CE is located at the center of the rotor r and connects to a center piece CP which is pushed toward the electrode CE by means of a spring SP. The rotor r is rotated by the driving shaft DS and distributes the above-mentioned high-voltage surge sequentially to each of the stationary terminals ST, via a discharging electrode r′ of this rotor r.

According to the present invention a unique member is introduced in the distributor D, so as to suppress the noise. A basic conception of the present invention is as follows. An hollow insulating member is located in the discharging air gap AG, formed between the discharging electrode r′ of the rotor r and the discharging electrode of the stationary terminal ST, and the spark discharge occurs by way of a through hole, formed inside the insulating member, between the electrode r′ and the electrode of the stationary terminal ST. The reason why the noise can be suppressed due to the presence of said through hole is not completely clear. However the following reason is considered to be reasonable: when an initial discharge occurs between the electrodes, air around the electrodes, including oxygen ($O_2$) gas and nitrogen ($N_2$) gas, is activated. The oxygen ($O_2$) and the nitrogen ($N_2$) are transformed into activated molecules such as ozone ($O_3$) and nitride oxides ($NO_x$), respectively. In the typical conventional distributor, such activated molecules ($O_3$, $NO_x$) are spread uniformly therein. However, according to the present invention, such activated molecules are not liable to spread uniformly inside the distributor, because the activated molecules are kept inside the through hole of the hollow insulating member. Therefore, the air in the through hole is left in a condition in which the spark discharge is very likely to occur. Consequently, the level of the discharge voltage can be reduced considerably, even though the spark gap is wider than the 6.35 mm employed in the previously mentioned first prior art example. The reduction of the level of the discharge voltage results in the suppression of noise. In this case, it is very important to know that the suppression of noise is not so remarkable if the level of the discharge voltage is reduced merely by shortening the distance of the spark gap, formed between the electrodes. However, such suppression of noise can be remarkable if the level of the discharge voltage is reduced without shortening the distance of the spark gap (refer to a graph of FIG. 14A explained hereinafter).

Now, seven embodiments, based on the aforesaid basic conception of the present invention, will be explained. Throughout these embodiments, it should be understood that the hollow insulating member of the present invention can be located on either the distributor rotor (r) side or the stationary terminals (ST) side. Alternatively, the hollow insulating members can be located, if necessary, on both the distributor rotor side and the stationary terminals side.

In each of the following embodiments, the hollow insulating member is located on the distributor rotor side.

First Embodiment

Figure 3A:
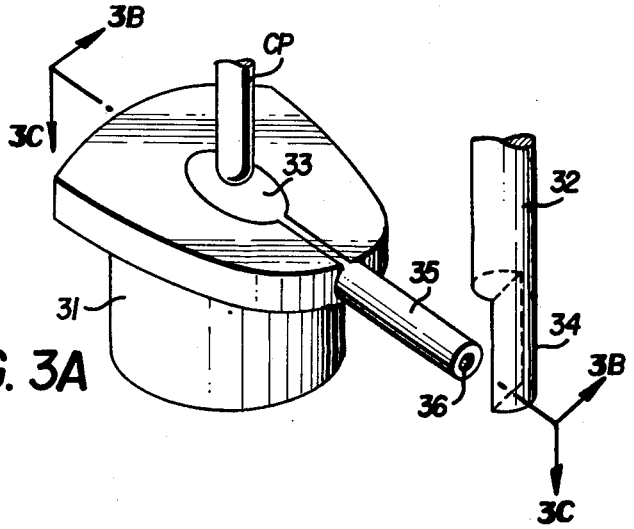
FIG. 3A is a perspective view showing a first embodiment according to the present invention.
Figure 3B:
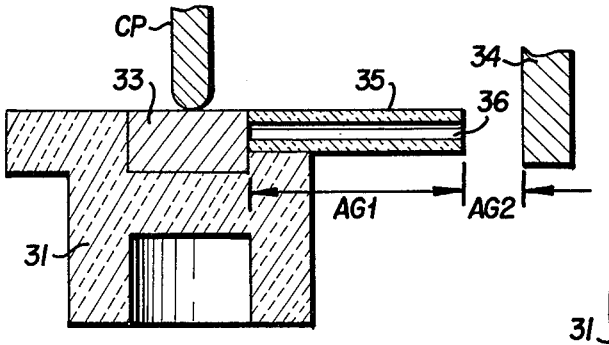
FIG. 3B is a cross-sectional view taken along the line 3B—3B shown in FIG. 3A.
Figure 3C:
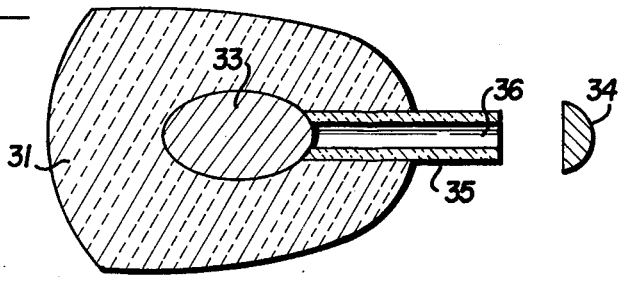
FIG. 3C is a cross-sectional view taken along the line 3C—3C shown in FIG. 3A.

FIG. 3A is a perspective view showing the first embodiment according to the present invention. FIG. 3B and FIG. 3C are cross-sectional views taken along the lines 3B—3B and 3C—3C shown in FIG. 3A, respectively. In the FIGS. 3A, 3B and 3C, the reference numeral 31 represents a distributor rotor (see the member r shown in FIG. 2), the reference numeral 32 represents a stationary terminal (see the member ST shown in FIG. 2), and the reference symbol CP represents the center piece. The distributor rotor 31, made of an insulating material, is provided with a discharging electrode 33, made of a conductive material. In this case, a discharging electrode having the shape of long strip, such as the discharging electrode r' shown in FIG. 2, is not used, but rather, the center piece CE shown in FIG. 2 simultaneously acts as such discharging electrode. A hollow insulating member 35, which is the most important member of the present invention, is inserted in the discharging air gap (see the portion AG in FIGS. 1 and 2). This discharging air gap is formed between the discharging electrode 33 (corresponding to said center piece CE) and a discharging electrode 34 of the stationary terminal 32. A through hole 36 is formed in the hollow insulating member. Thus, the spark discharge occurs between the discharging electrodes 33 and 34 by way of, in FIG. 3B, the discharging air gap AG1, defined by the through hole 36, and the discharging air gap AG2 which corresponds to the typical conventional discharging air gap. Consequently, a total discharging gap distance (AG1+AG2) becomes longer in distance, for example 6.8 mm, than that of the previously mentioned first prior art example (e.g. 6.35 mm.) However, contrary to the first prior art example, the level of the discharge voltage is not increased.

Second Embodiment

Figure 4A:
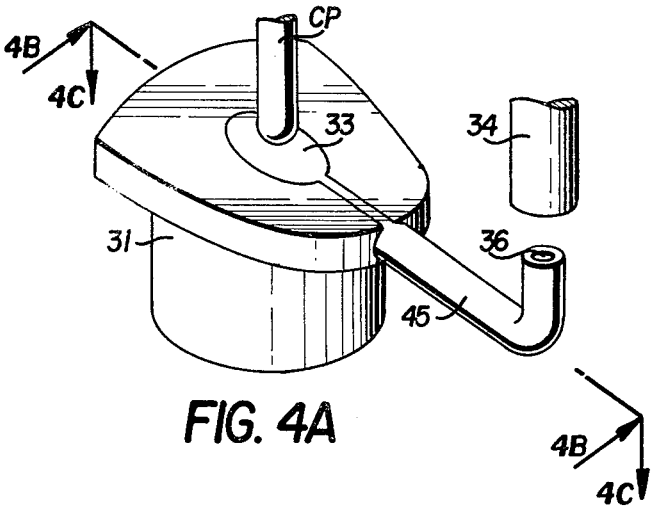
FIG. 4A is a perspective view showing a second embodiment according to the present invention.
Figure 4B:
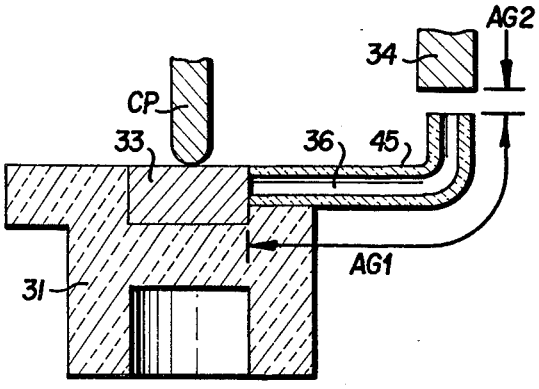
FIG. 4B is a cross-sectional view taken along the line 4B—4B shown in FIG. 4A.
Figure 4C:
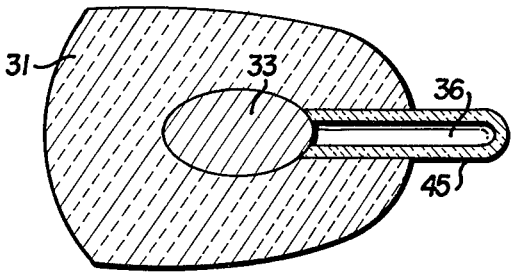
FIG. 4C is a cross-sectional view taken along the line 4C—4C shown in FIG. 4A.

FIG. 4A is a perspective view showing the second embodiment according to the present invention. FIG. 4B and FIG. 4C are cross-sectional views taken along the lines 4B—4B and 4C—4C shown in FIG. 4A, respectively. Members of FIGS. 4A, 4B and 4C are represented by the same reference numerals and symbols as those of FIGS. 3A, 3B and 3C, and are identical to each other. In the second embodiment, a hollow insulating member 45, having an L-shaped figure, is employed. Therefore, in FIG. 4B, the discharging air gap AG1 is also formed along an L-shaped path; the discharging air gap AG2 is formed between the end of the gap AG1 and the bottom of the discharging electrode 34. The second embodiment has an advantage in that the diameter of the distributor (D) can be decreased, when compared to that of the distributor based on the above-recited first embodiment. This is because the hollow insulating member 45 does not extend straightly, as does the hollow insulating member 35 of the first embodiment.

Third Embodiment

Figure 5:
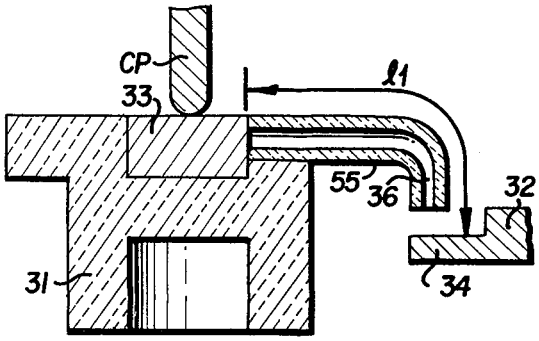
FIG. 5 is a longitudinally cross-sectional view of a third embodiment according to the present invention.

The third embodiment is a modified embodiment respect to the above-recited second embodiment. That is, in the second embodiment, the open end of the hollow insulating member 45 is directed upward. However, in the third embodiment the open end is directed downward. FIG. 5 is a longitudinally cross-sectional view showing the third embodiment according to the present invention. In FIG. 5, the open end of a hollow insulating member 55 is directed downward, which would correspond to the hollow insulating member 45 of FIG. 4B if the member 45 were rotated by 180°. In this case, the stationary terminal 32 should also be inclined by an angle of 90° with respect to the arrangement of the stationary terminal shown in FIG. 4A. Consequently, the open end of the hollow insulating member 55 does not face against the bottom of the discharging electrode 34, but against the side thereof. The third embodiment has an advantage in that an undesired spark discharge, moving straight between the discharging electrodes 33 and 34 without passing through the through hole 36, can completely be prevented from occurring. This is because the distance l1 between the electrodes 33 and 34 is far longer than that of the second embodiment (see FIG. 4B). It should be understood that, in FIG. 4B, an undesired spark discharge may possibly occur, moving straight between the discharging electrodes 33 and 34.

Fourth Embodiment

Figure 6:
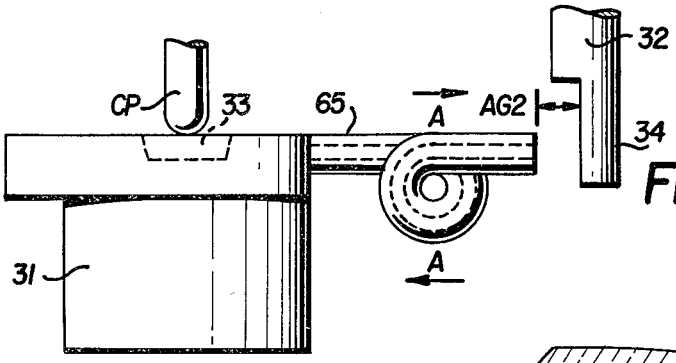
FIG. 6 is a side view of a fourth embodiment according to the present invention.

The fourth embodiment of the present invention is shown as a side view thereof in FIG. 6. In the fourth embodiment, a coil-shaped, hollow insulating member 65 is employed. Accordingly, a spark discharge starts from the discharging electrode 33 and makes one revolution along and in the through hole of the member 65, and finally reaches the discharging electrode 34, by way of discharging air gap AG2. This fourth embodiment has advantages in that, firstly, the length of the first discharging air gap (AG1), formed in the through hole, can be wider than that of any of the aforementioned embodiments and also can freely be selected for a wide range of lengths; and, secondly, the noise having a particular frequency (Hz) can automatically be suppressed due to the presence of the coil portion of the member 65. The reason why such noise can be suppressed is as follows: A spark discharge current, having the particular frequency (Hz), flows at diametric positions along said coil portion in opposite directions. For example, the spark discharge current flows in a direction along the arrow A, at the top of said coil portion, while the spark discharge current flows in a direction along the arrow A, at the bottom thereof. Thus, the spark discharge current, at diametric positions along the coil portion, flows in an opposite directions. Therefore, electromagnetic induction forces at diametric positions along the coil are cancelled by each other. As a result, the noise having the particular frequency (Hz) is automatically suppressed by the spark discharge current itself, flowing along the through hole of the coil portion.

Fifth Embodiment

Figure 7:
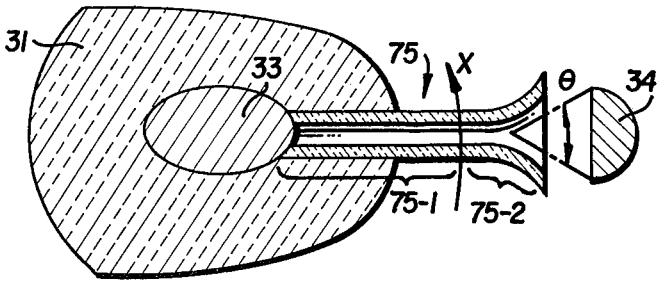
FIG. 7 is a laterally cross-sectional view of a fifth embodiment according to the present invention.
Figure 8A:
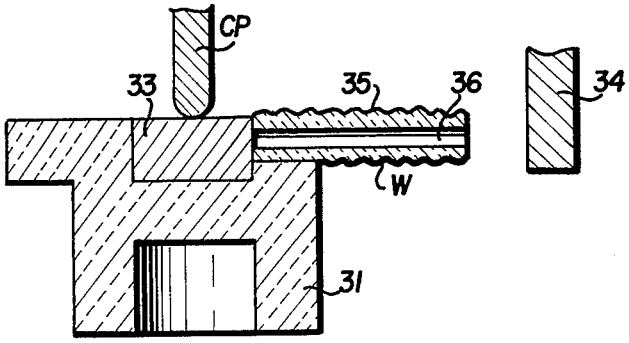
FIGS. 8A, 8B and 8C are cross-sectional views showing pleated surfaces applied onto outside surfaces of hollow insulating members of the first, second and third embodiments.
Figure 8B:
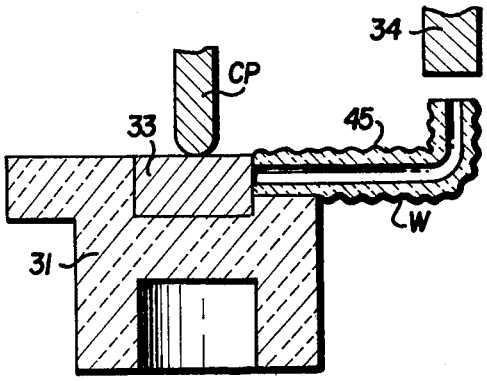
Figure 8C:
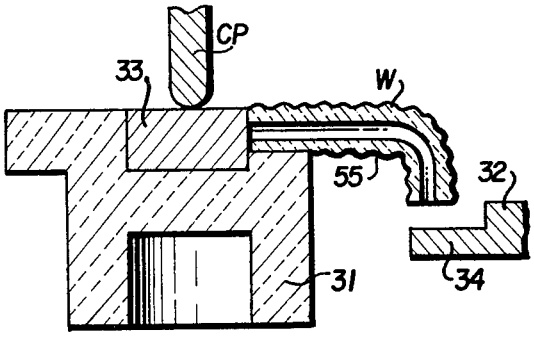
Figure 8D:
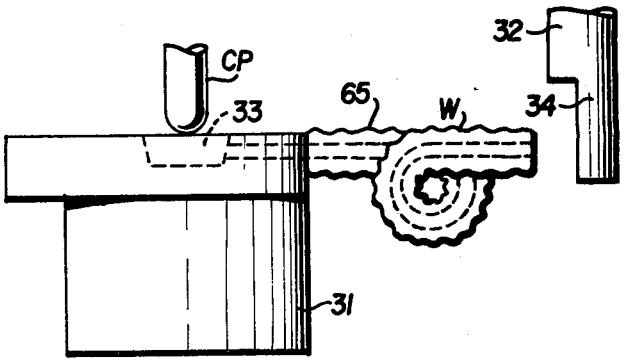
FIG. 8D is a side view showing a pleated surface applied onto the outside surface of the hollow insulating member of the fourth embodiment.
Figure 8E:
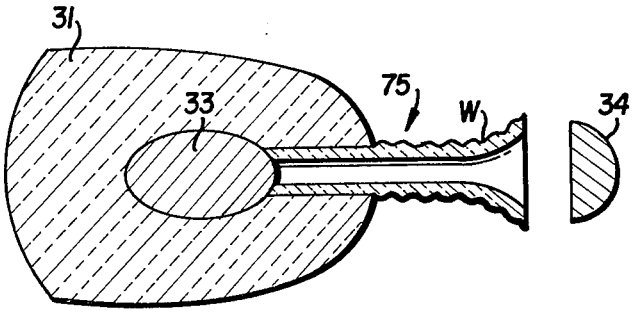
FIG. 8E is a cross-sectional view showing a pleated surface applied onto the outside surface of the hollow insulating member of the fifth embodiment.

The fifth embodiment of the present invention is shown, in a laterally cross-sectional view, in FIG. 7. In the fifth embodiment, a hollow insulating member 75 is comprised of a straight pipe portion 75-1 and a flat bugle-shaped portion 75-2, both connected in series. The open end of the flat bugle-shaped portion 75-2 faces toward the discharging electrode 34, via the discharging air gap. In the portion 75-2, a through hole is formed in the shape of an unfolded fan. The advantage of the fifth embodiment is that the spark discharge may easily fall within a wide range of variation by which the ignition timing of each spark plug is defined. The spark discharge, moving from the portion 75-1 through portion 75-2, can meet the discharging electrode 34 along a wide range of the rotational angle ($\theta$) in the rotational direction of the rotor 31 along the arrow X.

In each of the above-mentioned first through fifth embodiments, it is important to generate the spark discharge, between the discharging electrodes 33 and 34, not along the straight path between the electrodes 33 and 34, but along the through hole of the hollow insulating member. If the spark discharge is generated outside the hollow insulating member, the previously mentioned basic conception of the present invention cannot be made effective. A first method, according to the present invention, for preventing the undesired spark discharge from occurring along a straight path between the electrodes 33 and 34 outside of the through hole is as follows: the creeping distance of the outside surface of the hollow insulating member is made far longer than that of the inside surface thereof. Specifically, the outside surface of the hollow insulating member has a pleated surface. The technique for shaping the pleated surface on an insulating member for the purpose of preventing a creeping discharge from occurring has long been known (e.g. the pleated surface of an insulator used in a power transmission line or the pleated surface of an insulator used in a spark plug). FIG. 8A, FIG. 8B, FIG. 8C, FIG. 8D and FIG. 8E, are views showing the pleated surfaces on the outside surfaces of the hollow insulating members of the first through fifth embodiments, respectively. In each of these FIGS. 8A through 8E, the reference symbol W represents the above-mentioned pleated surface.

A second method, according to the present invention, for preventing the undesired spark discharge from occurring along straight path between the electrodes 33 and 34 without passing a through said through hole of the hollow insulating member is as follows: a semiconductor layer is formed on the inside surface, along the through hole of the hollow insulating member. In this case, the spark discharge is guided by the semiconductor layer, so that it travels from the electrode 33 to the electrode 34, along and in the through hole. Accordingly, the spark discharge is prevented from occurring outside the hollow insulating member. This semiconductor layer may be made of materials such as silicon carbide (SiC) or copper oxide (CuO), having the resistance value of $10^{-2}$ through $10^{6}$ Ω·cm.

Figure 9:
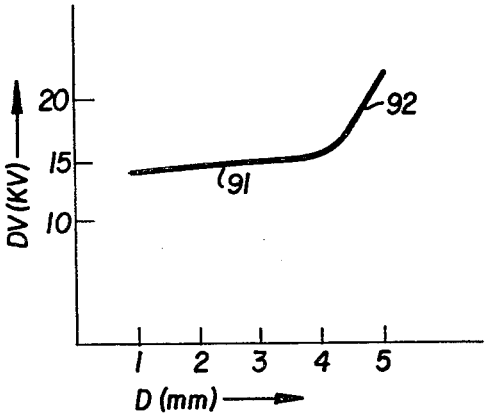
FIG. 9 is a graph revealing a relationship between the diameter (mm) of the through hole of the hollow insulating member and the level of a discharge voltage (KV)

The undesired spark discharge, occurring outside the through hole, can also be prevented from occurring by enlarging the diameter of the through hole. In other words, if the diameter of the through hole is reduced, the spark discharge can hardly occur via the through hole. The inventors have performed various experiments on the relationship between the diameter of the through hole and the discharge voltage and have discovered the following: the larger the diameter of the through hole becomes, the greater the probability that the spark discharge will pass through the through hole. However, the level of the discharge voltage is reduced in proportion to the increase of the diameter. The above-mentioned fact will be clarified with reference to the graph indicated in FIG. 9. In the graph of FIG. 9, the abscissa indicates the diameter D in mm and the ordinate indicates the level of the discharge voltage DV in kV. A curve 91 and a curve 92 represent characteristics when the diameter D is selected within the range of 1 mm through 4 mm. It should be recognized that, within such range of 1 mm through 4 mm, the spark discharge is very stable. However, when the diameter D is wider than 4 mm, the level of the discharge voltage increases steeply (see curve 92) in proportion to the increase of the diameter D, and, accordingly, the level of noise also increases greatly. Thus, it follows that the diameter D is preferably within 1 through 4 mm (corresponding to the curve 91), so that stable and relatively low discharge voltage may be obtained.

Regarding material for making the hollow insulating member, the hollow insulating member is made of an insulating material, preferably ceramic, glass or synthetic resin, most preferably the ceramics. In the example of the present invention, a ceramic, having a trade name of MACHOL, produced by the Corning Glass Works, is used, in which the ceramic has the resistance value of $10^{14}$ Ω·cm being substantially the same as that of glass which conventionally has the resistance value of $10^{15}$ Ω·cm.

Regarding materials for making the rotor (31) and the hollow insulating member (35, 45, 55, 65, 75), it is not necessary to use different materials from that of the other, as shown in each of FIGS. 3B, 3C, 4B, 4C, 5, 7, 8A, 8B, 8C and 8E. That is, in each of these Figures, the rotor and the hollow insulating member are made of different materials and fixed together by means of suitable adhesive materials (not shown). However, in view of a mass production process, it is preferable to fabricate both the rotor and the hollow insulating member, as one body, by using the same material through an integral forming process.

As previously mentioned, the object is to prevent an undesired spark discharge from moving in a straight path without passing through the through hole between the electrodes 33 and 34. Two methods for accomplishing this object have already been described. One of the two methods is to form the pleated surface (W) on the surface of the hollow insulating member, and the other is to form the semiconductor layer inside the surface of the hollow insulating member, along the through hole.

The invention must also prevent an undesired spark discharge from occurring between the electrode 33 and either one or more electrodes 34 of the stationary terminals 32 that the electrode 33 is facing. The methods for preventing such an occurrence have already been described; the formation of the pleated surface (W) (see FIGS. 8A through 8E) of the hollow insulating member and the formation of the semiconductor layer on the inside surface.

Figure 10:
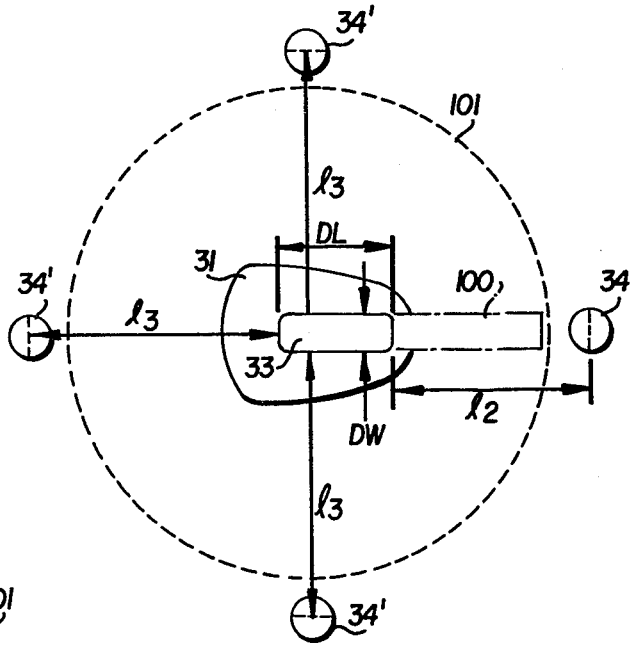
FIG. 10 is a plan view showing the rotor and the stationary terminals, used for explaining the configuration of the surface of the rotor, according to the present invention.

A first method, according to the present invention, for preventing the undesired spark discharge from occurring between the electrode 33 and any of the electrodes 34 to which the hollow insulating member does not face will be explained with reference to FIG. 10. FIG. 10 illustrates the rotor 31 and the electrodes 34 of the stationary terminals, as a plan view. In FIG. 10, a chain dotted line 100 represents the aforementioned hollow insulating member. The discharging electrode 33 connects with one end of the hollow insulating member. If the discharging electrode 33 is constructed to have a particular shape, it is hard to generate the spark discharge between the discharging electrode 33 and the discharging electrode 34'. The discharging electrode 34' represents any of the discharge electrodes to which the hollow insulating member does not face. The above-mentioned particular shape is defined as follows: in the discharging electrode 33, the length of DL is selected to be longer than that of DW (DL >DW), where the symbol DL denotes the length, parallel to the radius of a circular locus of the distributor rotor of the discharging electrode 33, while the symbol DW denotes the length, parallel to the direction which is perpendicular to the direction in which said radius is located. In this case, the discharging distance l2, between the discharging electrodes 33 and 34, can always be longer than the discharging gap l3, between the discharging electrode 33 and any one of the discharging electrodes 34 (i.e. l2 <l3). As a result, it is hard to generate an undesired spark discharge occurring along any one of the arrows indicated by the symbols l3.

Figure 11A:
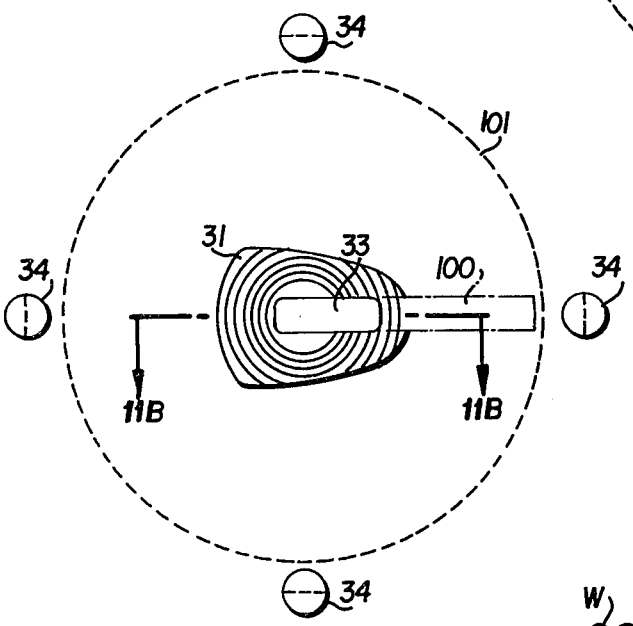
FIG. 11A is a plan view of the distributor rotor which is fabricated, according to the present invention.
Figure 11B:
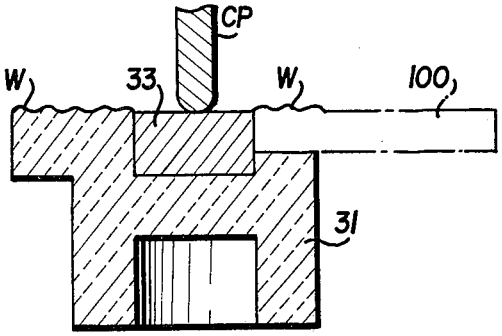
FIG. 11B is a cross-sectional view taken along the line 11B—11B shown in FIG. 11A.

A second method, according to the present invention, for preventing the above-mentioned undesired spark discharge from occurring will be explained with reference to FIGS. 11A and 11B. According to this second method, a pleated surface is formed on the top surface of the distributor rotor. The pleated surface is formed in such a manner that the pleats thereof are arranged concentrically with the circular locus 101 which has been explained before in FIG. 10. As a result, the creeping distance between the electrode 33 and each electrode 34, can be enlarged, and, accordingly, it is hard to generate such an undesired spark discharge between the electrodes 33 and 34'. FIG. 11A is a plan view of the distributor rotor which is fabricated in accordance with the above-mentioned second method, and FIG. 11B is a cross-sectional view taken along the line 11B—11B shown in FIG. 11A. The basic idea for performing this second method is identical to the idea for constructing the aforesaid embodiments illustrated in FIGS. 8A through 8E. Therefore, the pleated surface W illustrated in FIG. 11B is identical to the pleated surfaces W shown in FIGS. 8A through 8E.

In each of the above-mentioned embodiments, the hollow insulating member is located on the distributor rotor side. However, said hollow insulating member may be located on the stationary terminals side, too.

Sixth Embodiment

The sixth embodiment is illustrated in FIG. 12, as a partially cross-sectional view. In FIG. 12, members, which are represented by the same reference numerals or symbols as those of FIGS. 3A and 3B, are identical with each other. For example, six stationary terminals 32 (however, only one stationary terminal 32 is shown in FIG. 12) are supported by an insulating support member (distributor cap), made of insulating material 1201, and the discharging electrode of the stationary terminal 32 is represented by the reference numeral 1202. The discharging electrode 1202 faces toward a discharging electrode 1203 of the distributor rotor 31. As seen from FIG. 12, the electrode 1203 is a conventional one as is the discharging electrode r' of FIG. 2, from which the electrode 1203 extends externally from the rotor 31 and parallelly in the direction in which the radius of the circular locus 101 (see FIG. 10) is located.

Thus, the hollow insulating member of the present invention can be constructed by the insulating support member 1201 itself and a through hole 1204 formed therein. The through hole 1204 of FIG. 12 extends along a stright line, as does the through holes 36 of the first embodiment shown in FIGS. 3A through 3C. However, it is not necessary that the figure of the through hole be straight, as is in this sixth embodiment.

Seventh Embodiment

The seventh embodiment is illustrated in FIG. 13, as a partially cross-sectional view. In FIG. 13, members, which are represented by the same reference numerals or symbols as those of FIG. 12, are identical with each other. In the seventh embodiment, only the member 1304 is newly introduced in the distributor. The member 1304 is the through hole and is formed as an L-shaped through hole. The L-shaped through hole 1304 is similar to the L-shaped through hole 36 of the second embodiment, shown in FIGS. 4A through 4C.

Throughout the first through seventh embodiments, it is necessary to prevent an undesired spark discharge from occurring between the center piece CP and any one of the stationary terminals 32. In order to satisfy this requirement, the aforesaid pleated surface can also be formed on the inside surface of the insulating support member. The pleated surface is indicated by the reference symbol W in each of FIGS. 2, 12 and 13. The pleated surface W is preferably formed in such a manner that the pleats are arranged concentrically with the circular locus of the distributor rotor (see the circle 101 of FIG. 10). It should be understood that, in FIG. 2, which illustrates a typical conventional distributor, the pleated surface W, according to the present invention, is illustrated only for the purpose of facilitating the understanding of the location of the surface W in the distributor, and accordingly, a conventional insulating support member (distributor cap) is not provided with such pleated surface.

As previously mentioned, the basic concept of the present invention is to locate the hollow insulating member in the discharging air gap, which is formed between the discharging electrode r' of the distributor rotor r and the discharging electrode of each stationary terminal, and to generate the spark discharge through the through hole of the hollow insulating member. Thereby the level of the discharge voltage can be reduced. This fact, regarding the reduction in level of the discharge voltage, can be proved by an experiment. The resultant data of the experiment are depicted in the graph shown in FIG. 14A. In the graph of FIG. 14A, the abscissa indicates the gap distance g, between a pair of discharging electrodes, in mm, and the ordinate indicates the level of the discharge voltage DV in kV. In the graph, a curve Ⓑ represents the characteristics of the discharge voltage vs the gap distance, obtained through an experiment achieved with a layout illustrated in FIG. 14B. Similarly, a curve Ⓒ and a curve Ⓓ, respectively represent the characteristics of the discharge voltage vs the gap distance, obtained through experiments achieved with layouts illustrated in FIGS. 14C and 14D. According to the layout of FIG. 14B, one pair of discharging electrodes 1401 and 1402 simply face each other in the air, through a space of the gap distance g. Such layout of FIG. 14B corresponds to the layout used in a conventional distributor which contains no capability for suppressing noise. According to the layout of FIG. 14C, one pair of the discharging electrodes 1401 and 1402 is arranged on a surface of a dielectric plate 1403, through a space of the gap distance g. Such layout of FIG. 14C corresponds to the layout used in the distributor which is substantially the same as the previously recited fourth prior art example, disclosed in the Japanese Patent publication No. 52-15737. The layout of FIG. 14D is substantially the same as the layout according to the present invention, and, accordingly, the aforesaid hollow insulating member is substituted for an insulating pipe 1404. One pair of the discharging electrodes 1401 and 1402 face each other, in the pipe 1404, via a space of the gap distance g. As apparent from the characteristics curves shown in FIG. 14A, the level of the discharge voltage of the curve Ⓓ, corresponding to the present invention displays a level which is lower than those of the curves Ⓑ and Ⓒ, at every same gap distance g, which means that the present invention is effective for suppressing noise.

Figure 15A:
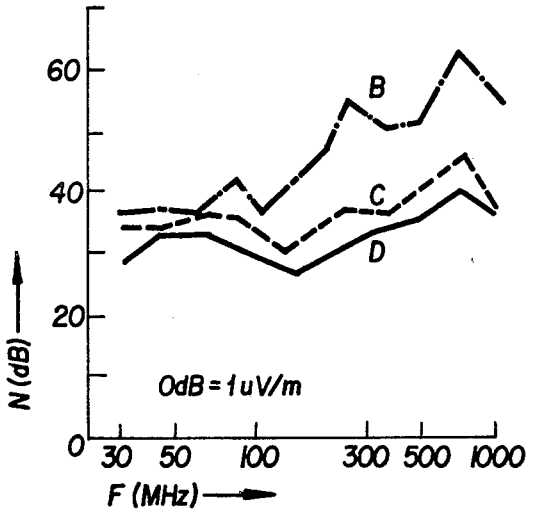
FIG. 15A is a graph depicting changes of the noise-field intensity level in dB produced by the distributors of the prior art and the present invention; and, FIGS. 15B, 15C and 15D illustrate distributors used for obtaining characteristics curves Ⓑ, Ⓒ and Ⓓ shown in FIG. 15A.
Figure 15B:
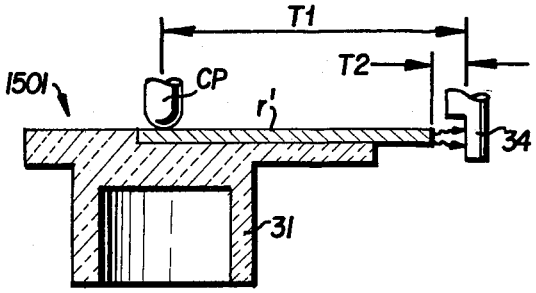
Figure 15C:
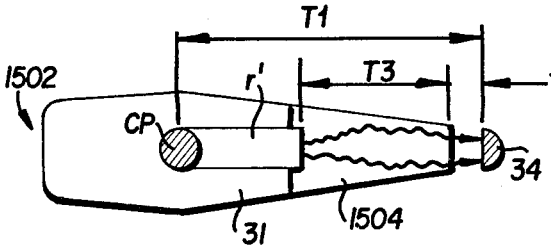
Figure 15D:
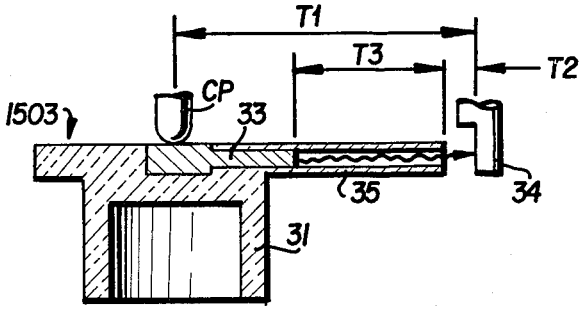

Based on the above-mentioned fact, explained with reference to FIGS. 14A through 14D, the inventors have achieved experiments on the noise-field intensity level, wherein the distributor is mounted in an actual vehicle, and they found the following resultant data. FIG. 15A depicts a graph indicating the resultant data of said experiments. In the graph of FIG. 15A, the abscissa indicates an observed frequency F in MHz and the ordinate indicates the level of the noise-field intensity N in dB, in which 0 dB corresponds to 1 $\mu$V/m. In the graph, a curve Ⓑ represents the characteristics of the noise-field intensity, measured by using an actual vehicle having a distributor as shown in FIG. 15B. Similarly, a curve Ⓒ and a curve Ⓓ, respectively represent the characteristics, measured by using actual vehicles having distributors as shown in FIGS. 15C and 15D. A distributor 1501 shown in FIG. 15B has no means for suppressing noise. A distributor 1502, illustrated as a plan view thereof in FIG. 15C, corresponds to the previously mentioned fourth prior art example (Japanese Patent publication No. 52-15737). That is, the spark discharge occurs on and along the surface of a dielectric plate 1504. A distributor 1503 of FIG. 15D is the same as the distributor according to the present invention. The members 33 and 34, in FIG. 15D, have already been explained. As apparent from the characteristics curves shown in FIG. 15A, the level of the noise-field intensity of the curve Ⓓ, corresponding to the present invention, displays a level which is lower than those of the curves Ⓑ and Ⓒ, at corresponding frequencies F, to proving that the capacity for suppressing noise, due to the presence of the hollow insulating member, is very remarkable. The following Table indicates, for reference, each length of distances $T_1$ and $T_2$ in the distributors 1501, 1502 and 1503, shown in FIGS. 15B, 15C and 15D, respectively.

TABLE

| | $T_1$ (mm) | $T_2$ (mm) | $T_3$ (mm) |
|---|---|---|---|
| 1501 | 27.8 | 0.8 | |
| 1502 | 27.8 | 0.8 | 6.0 |
| 1503 | 27.8 | 0.8 | 6.0 |

As mentioned above in detail, the distributor of the present invention has a very strong capability for suppressing noise.

We claim:

1. A distributor for an internal combustion engine, comprising an apparatus for suppressing noise, said distributor comprising:

a rotor made of insulating material having a first discharging electrode and being rotated by a driving shaft of the internal combustion engine;

a plurality of stationary terminals fixed to an insulating support member, each stationary terminal provided with a second discharging electrode, said stationary terminals arranged along a circular locus with said rotor at the center of the circular locus, each of said second discharging electrodes being separated from said first discharging electrode by a discharging air gap through which a spark discharge is generated;

said apparatus for suppressing noise comprising means for preventing the random motion of combustible gaseous molecules in said discharge gap when said spark discharge is generated, said apparatus for suppressing noise comprising a tubular insulating member having a first end secured in abutment with said first discharging electrode and a second end extending into said discharge gap;

said tubular member forming a cylindrical passage in said discharge gap through which said spark discharge passes.

2. A distributor for an internal combustion engine, comprising an apparatus for suppressing noise, said distributor comprising:

a rotor made of insulating material having a first discharging electrode and being rotated by a driving shaft of the internal combustion engine;

a plurality of stationary terminals fixed to an insulating support member, each stationary terminal provided with a second discharging electrode, said stationary terminals arranged along a circular locus with said rotor at the center of the circular locus, each of said second discharging electrodes being separated from said first discharging electrode by a discharging air gap through which a spark discharge is generated;

said apparatus for suppressing noise comprising means for preventing the random motion of combustible gaseous molecules in said discharge gap when said spark discharge is generated, said apparatus for suppressing noise comprising a plurality of tubular insulating members having a first end secured in abutment with said plurality of said discharging electrodes and a second end extending into said discharging gap;

said tubular member forming a cylindrical passage in said discharge gap through which said spark discharge passes.

3. A distributor as set forth in claim 1, wherein said insulating member is a straight tubular member.

4. A distributor as set forth in claim 1, wherein said insulating member is an L-shaped tubular member with a first arm extending along the radius of said circular locus and a second arm extending upward in a direction perpendicular to the radius of said circular locus.

5. A distributor as set forth in claim 1, wherein said insulating member is an L-shaped tubular member with a first arm extending in a direction along the radius of said circular locus and a second arm extending downward in a direction perpendicular to the radius of said circular locus.

6. A distributor as set for in claim 1, wherein said insulating member is a coil shaped tubular member.

7. A distributor as set forth in claim 1, wherein said second end of said insulating member comprises a flat bugle-shaped portion.

8. A distributor as set forth in claim 1, wherein the outside surface of said insulating member is pleated.

9. A distributor as set forth in claim 1, wherein the walls of said cylindrical passage are covered with a semiconductor layer.

10. A distributor is set forth in claim 1, wherein the diameter of said cylindrical passage is from 1 mm to 4 mm.

11. A distributor as set forth in claim 1, wherein said insulating member is made of ceramics.

12. A distributor as set forth in claim 1, wherein said insulating member is made of glass.

13. A distributor as set forth in claim 1, wherein said insulating member is made of synthetic resin.

14. A distributor as set forth in claim 1, wherein said insulating member and rotor are of one piece construction.

15. A distributor as set forth in claim 1, wherein a pleated surface, having a plurality of pleats which are concentric with said circular locus, is formed on the top surface of said rotor.

16. A distributor as set forth in claim 2, wherein a plurality of pleats, concentric with said circular locus, are formed in the walls of said cylindrical passage.

17. A distributor as set forth in claim 2, wherein said first discharging electrode extends to a point adjacent to the second discharging electrodes.

18. A distributor as set forth in claim 2, wherein said plurality of insulating members are straight tubular members.

19. A distributor as set forth in claim 2, wherein the outside surface of said plurality of insulating members is pleated.

20. A distributor as set forth in claim 2, wherein the walls of said cylindrical passage are covered with a semiconductor layer.

21. A distributor as set forth in claim 2, wherein the diameter of said cylindrical passage is from 1 mm to 4 mm.

22. A distributor as set forth in claim 2, wherein said plurality of insulating members are made of ceramics.

23. A distributor as set forth in claim 22, wherein said plurality of insulating members are made of glass.

24. A distributor as set forth in claim 2, wherein said plurality of insulating members are made of synthetic resin.

* * * * *